US006893682B2

(12) United States Patent
Halmschlager et al.

(10) Patent No.: US 6,893,682 B2
(45) Date of Patent: May 17, 2005

(54) METHOD AND DEVICE FOR SINGLE-OR DOUBLE-SIDED APPLICATION

(75) Inventors: Gunter Halmschlager, Krems (AT); Herbert Haunlieb, Loosdorf (AT); Wilhelm Gansberger, Ober-Grafendorf (AT); Erich Brunnauer, Krems/Rehberg (AT); Stefan Lehner-Dittenberger, Wilhelmsburg (AT); Martin Vogt, Prinzersdorf (AT)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/069,815

(22) PCT Filed: Jul. 6, 2001

(86) PCT No.: PCT/EP01/07785

§ 371 (c)(1),
(2), (4) Date: May 3, 2002

(87) PCT Pub. No.: WO02/04745

PCT Pub. Date: Jan. 17, 2002

(65) Prior Publication Data

US 2002/0164428 A1 Nov. 7, 2002

(30) Foreign Application Priority Data

Jul. 7, 2000 (DE) ..... 100 33 213

(51) Int. Cl.[7] ..... B05D 3/12; B05C 11/02

(52) U.S. Cl. ..... 427/361; 427/365; 427/369; 427/209; 427/211; 427/428.01; 427/428.21; 118/50; 118/68; 118/106; 118/117; 118/223; 118/224; 118/239; 118/248

(58) Field of Search ..... 427/428, 365, 427/369, 209, 211, 428.01, 428.21; 118/106, 117, 223, 224, 239, 248, 50, 68

(56) References Cited

U.S. PATENT DOCUMENTS

| | | | | | |
|---|---|---|---|---|---|
| 5,683,509 | A | | 11/1997 | Sollinger et al. | 118/227 |
| 5,951,821 | A | * | 9/1999 | Laapotti | 162/205 |
| 6,228,216 | B1 | * | 5/2001 | Lindsay et al. | 162/111 |
| 6,372,090 | B1 | * | 4/2002 | Laapotti | 162/206 |

FOREIGN PATENT DOCUMENTS

| | | | | |
|---|---|---|---|---|
| DE | 198 23 739 A1 | | 11/1999 | D21H/23/28 |
| JP | 48-041007 | * | 6/1973 | |
| WO | 99/45203 | * | 9/1999 | |
| WO | 99/55966 | * | 11/1999 | |

* cited by examiner

*Primary Examiner*—Katherine Bareford
(74) *Attorney, Agent, or Firm*—Taylor & Aust, P.C.

(57) ABSTRACT

A method for the application of liquid through viscid medium onto the surface of a pre-dried material web including the steps of applying a viscid medium to at least one side of the material web, routing the material web through a press nip and supporting the material web substantially without free draw.

20 Claims, 2 Drawing Sheets

METHOD AND DEVICE FOR SINGLE-OR DOUBLE-SIDED APPLICATION

BACKGROUND OF THE INVENTION

1. Field of the Invention

The invention relates to a method and device for the application of a liquid medium onto a material web, and, more particularly, to a method and device for the application of liquid through viscid mediums onto a pre-dried material web.

2. Description of the Related Art

In the direct application process a liquid or viscid medium is applied directly by an applicator device to the surface of a moving material web, which is supported during the application process by a rotating support surface, such as a backing roll or a continuous belt. The liquid or viscid medium is initially applied to a carrier surface, such as the surface of a roll serving as an applicator roll, or the surface of one side of a flexible belt, and is transferred therefrom to the material web.

Indirect application is normally accomplished by a so-called film press implemented by two rolls, which together form a nip, and which transfer the medium successively or simultaneously to both sides of the material web or to only one side of the web.

Reference is made to U.S. Pat. No. 5,683,509 which discloses a flexible continuous belt, together with a transfer roll, which form the press nip through which the web travels. A press shoe is located on the inside of the continuous belt, thereby extending the nip and pressing the coating medium, that is applied by this unit, into the web. This improves the coating result, specifically by avoiding film splitting.

Reference is also made to DE 198 23 739 A1, according to which, a material web is coated in the wet section or immediately following the wet section, of a paper machine.

Film or size presses have been in operation for years. They have some significant disadvantages when utilized with today's high-speed machines, and depending upon the type of fiber web and coating medium, they do not always provide sufficient coating quality.

The raw material quality of paper or cardboard is continuously degrading. This is particularly true of the production of corrugated board base paper, which is largely manufactured from recovered paper. There is also an ever increasing demand for a lower mass per unit area (also referred to as basis weight). The result of using poor raw material quality and lower basis weight is that the tensile strength of the web, following the film press coating application, is very low, resulting in frequent web breaks after the coating of the web. This results in enormous production down times and associated high costs.

Film Presses, variously known as Speedsizer, Speedcoater, Optisizer or metering size press, frequently cause nip flattening and crushing in the nip. These effects are particularly negative in corrugated board production.

In the field, web breaks, particularly in the production of corrugated board base paper, are reduced by using modified starches, that have a low viscosity and a high solids content, as a coating medium. The low viscosity provides effective penetration and the high solids content produce low remoistening, thereby rendering possible only a low drop in tensile strength following the film press. However, modified starches are more expensive as compared to crystal starches.

Even these measures do not always lead to satisfactory results.

SUMMARY OF THE INVENTION

The present invention provides a method and a device for the production of corrugated board base paper, whereby a deep penetration of coating medium containing starch into the material web, independent of the basis weight, and by utilizing the starch characteristics, is accomplished and web breaks are largely avoided.

The inventors recognized that the hitherto used starches, whose viscosity and solids contents were modified, produced only an insignificant increase in strength of the coated and impregnated material web, as compared to crystal starches.

The positive effects of the starch in the coating medium increase since the pre-dried corrugated board base paper web travels through a press nip only after coating, and because the web is dried a considerable distance after the nip, essentially the distance to the first dryer cylinder, being supported without free draw.

An advantage of the present invention is that a penetration through to the "sheet center" can be achieved, even at low basis weights, resulting in an increase of the web's tensile strength.

Another advantage is that it is now possible to use crystal starches in spite of intensive remoistening. Crushing during corrugated board base paper production is reliably avoided.

A further advantage of the present invention is that fewer web breaks occur following the coating process.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
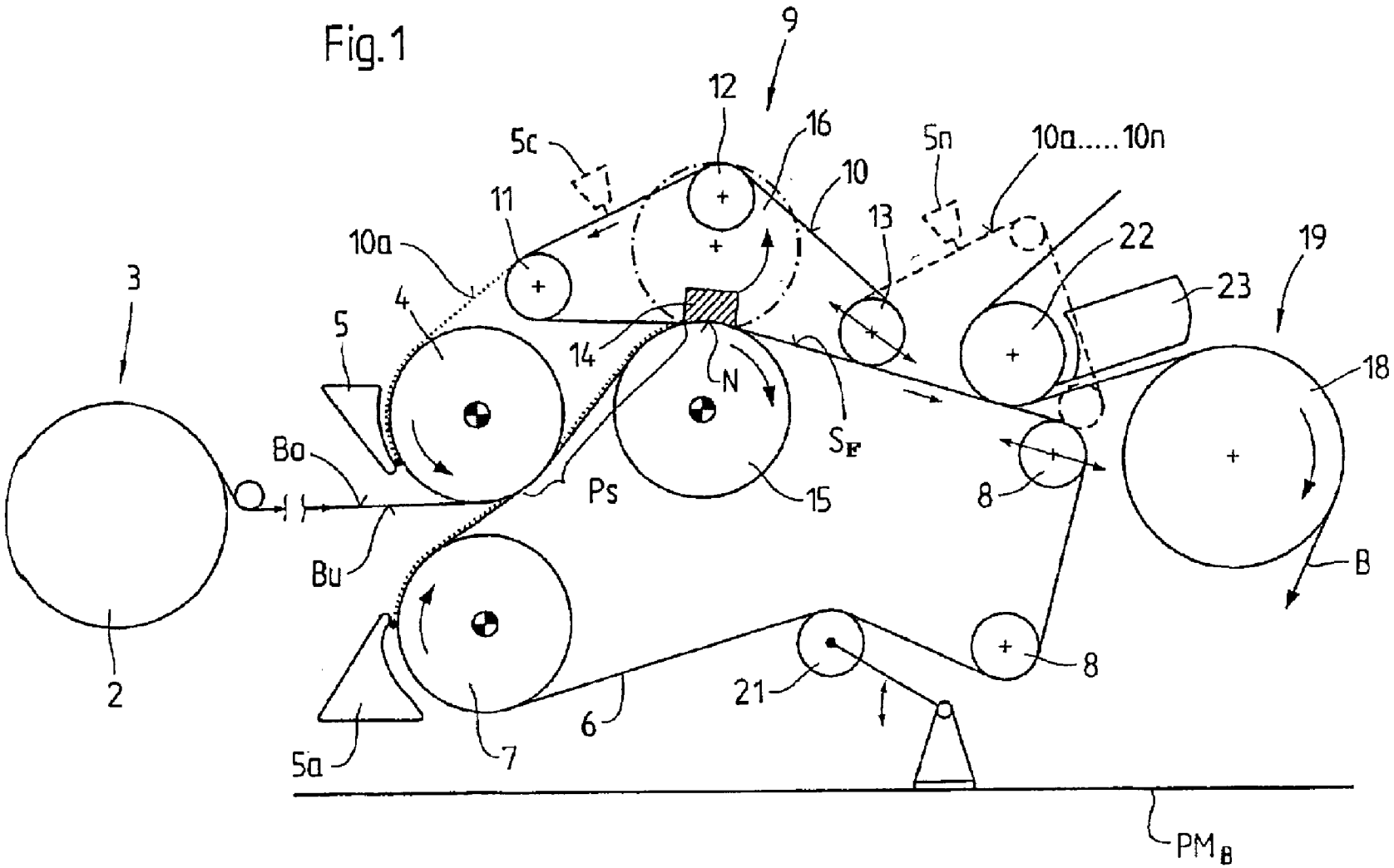
FIG. 1 is a schematic side view of one embodiment of a device for the one or two sided application of a liquid through viscid mediums onto a pre-dried material web of the present invention.

Referring now to the drawings, and more particularly to FIG. 1, there is illustrated a pre-dried corrugated board base paper web B that has a dry content of approximately 85 to 95%, following a last dryer cylinder 2 of pre-dryer group 3, in a machine for the production of corrugated board base paper, running onto a first applicator roll 4. Applicator roll 4 has an applicator device 5 assigned to it, with which web B is coated on it's top side $B_o$. All known coating devices, such as a Short Dwell Time Applicator (SDTA), Long Dwell-Time Applicator (LDTA), open jet nozzle applicators or a curtain coating nozzles are suitable. A pre-penetration of the coating medium is achieved with this one- or two-sided application.

In order to support web B, a transfer belt, that is a flexible continuous synthetic or rubber belt, is routed around additional roll 16, a support or backing roll 7 and around several guide or turning rollers 8. A tension roll 21, which is located on the paper machine floor $PM_B$, reacts on belt 6 from the outside, thereby tensioning it.

Whereas a two-sided application is illustrated, applicator 5*a* is assigned to support roller 7. The coating medium is transferred from continuous belt 6 to underside $B_U$ of web B, as soon as belt 6 makes contact with web B. The application by applicators 5 and 5*a* may occur simultaneously, or successively in an offset time sequence. If only a one-sided application is to occur, on either the topside or the underside of the web, one of the idle applicator devices are pivoted down. As can be seen in FIG. 1, rolls 4 and 7 together do not form a press nip. This is intentional, so that no crushing of the web is caused and no web breaks occur.

The embodiment illustrated in FIG. 1, includes a long pre-penetration segment $P_g$, that ought to be considerably longer than 100 mm, thereby providing good penetration due to the capillary effect during the extended reaction time. This long distance is particularly advantageous in achieving the desired through-penetration.

Figure 2:
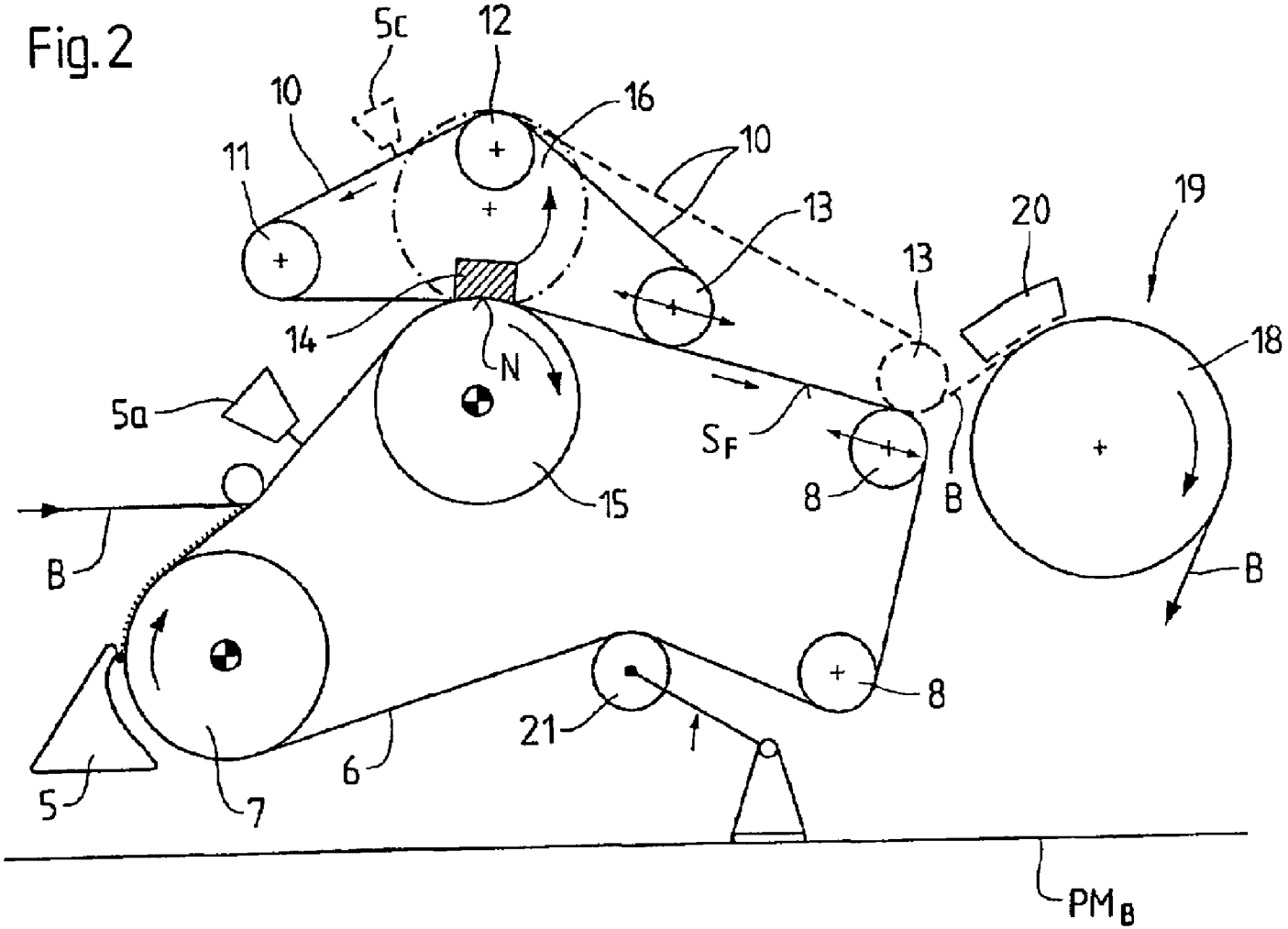
FIG. 2 is a schematic side view of a second embodiment of the present invention.

Now additionally referring to FIG. 2, which essentially uses the identical references for the identical components as FIG. 1, there is shown another embodiment of the invention. In this embodiment there is no roll 4; only applicator device 5 is present for direct application of coating onto the topside of web $B_o$. Alternatively, an additional continuous belt, in place of the roll 4, may be utilized with which web B is supported, and indirect coating of the material web is achieved.

After passing penetration segment $P_g$ web B runs together with belt 6, which can be used as an applicator and support belt, through press zone 9. Press zone 9 may be realized in various ways. In order to allow a long dwell time and avoid crushing, as well as to be able to adjust variable line pressures across the entire width of web B, a shoe press is utilized. In press zone 9 the pre-penetrated starch can after-penetrate, thereby anchoring itself solidly in web B.

Alternatively, press zone 9 may include an additional flexible continuous belt 10 running over guide rollers 11, 12 and 13. Belt 10 runs with it's inside surface over a slide face of press shoe 14, whereby the slide face, together with roll 15, which could for example be a suction roll, forms a press nip N. Press shoe 14 is shown in only as a simplified depiction and may extend over a large area of belt 10. Press zone 9 can also include rolls 15 and 16 which form a press nip N. In FIGS. 1 and 2, roll 15 is illustrated in a dash-dot configuration and embodies a so-called flexonip roll. This construction is already known from DE 198 20 516 A1, which is incorporated herein and made a part hereof, however there are no statements therein regarding supporting of the web after squeezing in the coating.

Roll 15 is one of those rolls, around which continuous belt 6 travels, forming the aforementioned backing surface to roll 16 and/or the belt acting as a press, support or applicator belt 10. Continuous belt 10, as well as continuous belt 6, each form a support surface therebetween for web B that is penetrated through after Nip N. Support surface $S_F$ extends essentially to first dryer cylinder 18, in the following dryer section 19, of the paper machine.

As indicated by the dashed lines, in FIG. 2, continuous belt 10 can be extended, to a desired extent, by adjustment of guide roller 13. Likewise belt 6 can also extend its support surface, to a desired extent, by adjusting upper guide roller 8. As is also shown in FIG. 2, an extended support surface provides for a blow box, suction roll or suction box 20, or for another type of transfer aid, to facilitate transfer of web B, or of a transfer strip, to dryer cylinder 18.

In FIG. 1 the possibility of supporting web B in the direction of the location of application is shown as a dotted line. For this purpose belt 10, or a separate belt 10*a*, is routed around roll 4, or around an adequately positioned guide roller. Belt 10*a* may also be additionally supported by roll 11. Alternatively, continuous belt 10*a* can replace roll 4, thereby providing the aforementioned support of web B, as well as indirect coating, at the same location as is being done with roll 4.

Belts 6 and 10 are equipped with a drive and rolls 4, 7 and 15 are driven. Relative to belt 6 this drive is located at nip N, in order to ensure sufficient pull of web B. In addition, tensioning devices, such as tensioning roller 21 and tension control devices, for the belts are provided, as well as belt adjustments which are indicated by double arrows at guide rolls 8 and 13.

In order to facilitate a flawless transfer of web B to dryer section 19, a suction roll 22, with or without foil 23, is provided after press zone 9 or continuous belt 10. This arrangement allows for a transfer of the web without ropes.

For the sake of completeness it must be mentioned that in order to facilitate a flawless transfer of web B, one or more showers (not depicted in the drawings) are provided prior to the point where belt 6 runs onto applicator roll 4. These provide a targeted liquid application onto belt 6 or web B, in order to ensure adhesion of the transfer strip or web B. In order to avoid lifting of web B at press roll 16, additional support belts, so-called fibron belts or other known transfer aids, can be provided. The paper machine section illustrated in FIGS. 1 and 2 is essentially consistent with a "closed transfer" into dryer section 19.

It is also feasible to include an additional applicator device 5*c* to continuous belt 10, thereby providing for a double application onto topside $B_o$ of web B. This may occur with or without intermediate drying. Additional support belts 10*a* . . . 10*n* or 6*a* . . . 6*n*, on one or both sides of web B, may be provided, which have associated applicator devices 5*a* . . . 5*n*, being of the same type or acting independently from each other. An advantage of this type of arrangement is that only a fraction of the starch is applied by each applicator device. This reduces the re-moistening of web B immediately after the application. Web B does not loose consistency, thereby increasing runability.

Overall, it has been determined in tests that the consistency gain of the paper and cardboard web is not approximately 20N/% starch as was the case previously, but 40N/% starch. This means that, while maintaining the same quality the starch amount can be reduced by 30%. Alternatively the quality is increased when the same amount of starch is used. This is especially important considering the drop in quality of raw materials used in the production of corrugated board base paper.

Furthermore crystal starches can now also be used.

While this invention has been described as having a preferred design, the present invention can be further modified within the spirit and scope of this disclosure. This application is therefor intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of application of liquid through viscid mediums onto the surface of a material web, comprising the steps of:

applying a viscid medium coating to at least one side of a pre-dried material web, the material web moving in a web direction;

routing the material web through a press nip; and supporting the material web with an extensible support surface, substantially without free draw, after said routing step, said extensible support surface being extensible in said web direction, said extensible support surface being partially supported by a roll, said roll being laterally movable substantially in said web direction.

2. The method of claim 1, wherein said supporting step includes supporting the material web by at least one flexible continuous belt substantially until the material web reaches a dryer cylinder of a downstream dryer group.

3. The method of claim 1, wherein said applying step includes the sub-steps of:

applying the viscid medium to an outside surface of a flexible continuous belt; and transferring the viscid medium from said outside surface of said flexible continuous belt to an underneath side of the material web.

4. The method of claim 3, wherein said flexible continuous belt is configured to provide support to the material web.

5. The method of claim 1, wherein said applying step includes the sub-steps of:

applying the viscid medium to one of an application roll and an outside surface of a flexible continuous belt; and transferring the viscid medium from one of said application roll and said outside surface of said flexible continuous belt to a top side of the material web.

6. The method of claim 5, wherein said flexible continuous belt is configured to provide support to the material web.

7. The method of claim 1, wherein said applying step includes the sub-steps of:

applying the viscid medium incrementally to a plurality of flexible continuous belts; and supporting the material web by at least one of said plurality of flexible continuous belts.

8. The method of claim 1, further comprising the step of conveying the material web through a penetration segment of greater than approximately 100 mm, prior to said routing step.

9. The method of claim 1, wherein the material web has a mass per unit area not exceeding 90 g/m$^2$.

10. The method of claim 1, wherein the material web has a dry-content of between approximately 85% and approximately 95%, prior to said applying step.

11. A coating device for a material web, comprising:

at least one application device configured to apply a viscid medium to the material web, the material web moving in a web direction, the material web being pre-dried prior to application of said viscid medium;

a first support roll;

a second support roll, said second support roll being movable relative to said first support roll, said second roll located apart from said first support roll;

a continuous belt supported by said first support roll and said second support roll, said continuous belt being an extensible support dependent on said second support roll, said extensible support supporting the material web substantially without free draw, said extensible support being extensible in said web direction, said second support roll being laterally movable substantially in said web direction; and a press shoe located proximate to said continuous belt forming a press nip therebetween, said press nip located downstream from said at least one application device.

12. The device of claim 11, wherein said at least one application device comprises a first application device disposed proximate to an outside surface of said continuous belt where said first support roll is in contact with said continuous belt, said first application device configured to deliver a viscid medium to said continuous belt for subsequent transfer to a side of the material web.

13. The device of claim 12, further comprising:

a plurality of guide rollers;

an application roll;

an other continuous belt disposed around said application roll and said plurality of guide rollers, said other continuous belt configured as a press belt;

a second application device disposed proximate to an outside surface of said other continuous belt where said application roll is in contact with said other continuous belt, said second application device configured to deliver a viscid medium to said other continuous belt for subsequent transfer to an other side of the material web.

14. The device of claim 13, further comprising a dryer section which includes at least one dryer cylinder; and wherein at least one of said continuous belt and said other continuous belt is configured to support the material web substantially to said at least one dryer cylinder.

15. The device of claim 14, further comprising a plurality of flexible continuous belts configured for incremental application of said viscid medium to a side of the material web, at least one of said plurality of flexible continuous belts being configured to support the material web through to said at least one dryer cylinder.

16. The device of claim 14, further comprising at least one of a suction roll, a suction box and a blow box located downstream of said press nip, each said suction roll, said suction box and said blow box being configured to transfer the material web to said at least one dryer cylinder.

17. The device of claim 13, where in said continuous belt and said other continuous belt are equipped with a drive.

18. The device of claim 13, wherein at least one of said plurality of guide rolls is adjustable.

19. The device of claim 11, further comprising a penetration segment having a length of greater than approximately 100 mm, said penetration segment disposed immediately upstream of said press nip.

20. The device of claim 11, wherein said device is configured to produce corrugated board base paper.

* * * * *

UNITED STATES PATENT AND TRADEMARK OFFICE

CERTIFICATE OF CORRECTION

PATENT NO. : 6,893,682 B2
DATED : May 17, 2005
INVENTOR(S) : Halmschlager et al.

It is certified that error appears in the above-identified patent and that said Letters Patent is hereby corrected as shown below:

Column 1,
Line 3, insert the following:
-- This case is a national stage application of PCT/EP01/07785, filed July 6, 2001. --.

Column 3,
Line 32, delete "$P_g$" and substitute -- $P_s$ --.

Signed and Sealed this

Tenth Day of January, 2006

JON W. DUDAS
*Director of the United States Patent and Trademark Office*